US006360849B1

(12) United States Patent
Hikita

(10) Patent No.: US 6,360,849 B1
(45) Date of Patent: Mar. 26, 2002

(54) ELEVATOR SYSTEM, INCLUDING CONTROL METHOD FOR CONTROLLING, MULTIPLE CARS IN A SINGLE SHAFT

(75) Inventor: Shiro Hikita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/613,750

(22) Filed: Jul. 11, 2000

(30) Foreign Application Priority Data

Aug. 6, 1999 (JP) ..... 11-223642

(51) Int. Cl.[7] ..... B66B 1/16
(52) U.S. Cl. ..... 187/381; 187/902
(58) Field of Search ..... 187/380, 381, 187/382, 388, 902

(56) References Cited

U.S. PATENT DOCUMENTS 4,632,224 A * 12/1986 Nowak et al. ..... 187/29 R
4,838,385 A * 6/1989 Ekholm ..... 187/101
5,625,176 A * 4/1997 Davis et al. ..... 187/393
6,167,351 A1 * 1/2001 Ikeda et al. ..... 187/387
6,237,721 B1 * 5/2001 Siikonen ..... 187/382

FOREIGN PATENT DOCUMENTS

JP 4-345476 12/1992

* cited by examiner

*Primary Examiner*—Jonathan Salata
(74) *Attorney, Agent, or Firm*—Leydig, Voit & Mayer, Ltd.

(57) ABSTRACT

An elevator system having cars in service at top and bottom in a single shaft with efficient group control. The elevator system is provided with a shaft assignment finalizing unit for selecting a shaft and a car to be assigned to a new call, and a reassigning unit for reassigning a car as necessary when a new call occurs after assignment is performed. After tentative assignment is finalized, if a new call is generated before a time for finalizing a stop of a tentatively assigned car is reached, then the tentative assignment is reviewed. If it is determined that reassigning of cars is necessary for a call, then the reassigning unit changes car assignment to the call. Assignment of a car is finalized by the car assignment finalizing unit, and information regarding a final decision is displayed by a display controller.

10 Claims, 8 Drawing Sheets

10F
9F
8F
7F
6F
5F
4F
3F
2F
1F
#A
#B
UPPER CAR IS TENTATIVELY ASSIGNED
UPPER CAR RESPONDS
LOWER CAR RESPONDS
▲ :NEW HALL CALL
△ :TENTATIVELY ASSIGNED HALL CALL

▼ :NEW HALL CALL

△ ▽ :TENTATIVELY ASSIGNED HALL CALL

○ :ASSIGNED CAR CALL

ELEVATOR SYSTEM, INCLUDING CONTROL METHOD FOR CONTROLLING, MULTIPLE CARS IN A SINGLE SHAFT

BACKGROUND OF THE INVENTION

1. Field of the Invention

The present invention relates to efficient control of an elevator system wherein a plurality of cars are provided at top and bottom in a single shaft and the plural cars are connected to each other, or an elevator system wherein a plurality of cars are provided at top and bottom in a single shaft and the plural cars are able to freely move.

2. Description of Related Art

In recent years, technologies have been reported regarding a double-decker elevator (hereinafter referred to as "DD elevator") wherein a plurality of cars are provided at top and bottom in a single shaft and relative positions of the plural cars are fixed, or a multi-cage elevator (hereinafter referred to as "MC" elevator) wherein a plurality of cars are provided at top and bottom in a single shaft and the plural cars can freely move. When a plurality of cars or elevator systems are provided, group control is usually carried out. There has also been a technological report on group control for the DD elevators or the MC elevators.

Regarding a DD elevator, in particular, there is a technological report given below.

(a) It is a basic rule in a DD elevator to make a lower car respond to a call for raising a car and to make an upper car to respond a call for lowering a car. If a call is generated on a floor adjacent to a floor where an already assigned call exists, then assignment is performed so as to enable a response to be given to these calls at the same time. (Japanese Examined Patent Publication No. 51-12898)

(b) A destination registering apparatus is installed at a hall, and calls for cars corresponding to destination floors are separately assigned to the upper and lower cars. The destination floors of the cars are displayed when the cars arrive. (Japanese Unexamined Patent Publication No. 4-345476)

The prior art has been posing the following problems.

An attempt in (a) above is to simultaneously respond to the calls from the adjacent floors. According to this method, however, there have been some cases wherein simultaneous responses are impossible, depending on a sequence in which calls occur. For instance, if the lower car is assigned first to a call made at a hall of a fifth floor to a request for going up, and a call is secondly made at a hall of a sixth floor to request for going up, then the upper car is assigned to the second call, thus making it possible to simultaneously respond to both calls. Conversely, however, if the call at the fifth floor takes place after the call at the sixth floor, then the lower car is assigned first to the call at the sixth floor, making it impossible to respond to the two calls at the same time.

In (b) above, the destination floors are displayed when the cars arrive at the halls in the DD elevator thereby to prevent passengers from becoming confused. However, no description is given to how to improve operation efficiency.

SUMMARY OF THE INVENTION

The present invention has been made with a view toward solving the problems described above, and it is an object of the invention to provide an elevator controller capable of carrying out more efficient group control on a DD elevator or an MC elevator.

To this end, according to one aspect of the present invention, there is provided an elevator system in which a plurality of cars are provided at top and bottom in the same shaft, comprising: a call registerer for entering a hall call; a tentative assignment finalizing unit for tentatively assigning a first car in response to a first call entered by the call registerer; and a reassigning unit for changing an assignment for the first call to a second car that is different from the first car after tentatively assigning the first car, depending upon a traffic situation of the elevator system.

In a preferred form, the reassigning unit changes the assignment for the first call if a second call that is different from the first call occurs after the first car has been tentatively assigned.

In another preferred form, the reassigning unit determines whether a predetermined time before the first car arrives at the floor where the first call occurred has been reached or not, and if the predetermined time has not been reached, then the assignment for the first call is changed.

In another preferred form, the reassigning unit changes the assignment in response to the first call to the second car in the shaft wherein the first car is in service.

In yet another preferred form, the call registerer registers a call by entering a destination floor, and the reassigning unit changes an assignment performed in response to the first call according to a destination floor entered at the first call and a destination floor entered at the second call.

In a further preferred form, the call registerer registers a call by entering a destination floor, and further comprising a display for displaying a destination floor of the second car according to a result of reassignment performed by the reassigning unit.

In another preferred form, the elevator system further comprises an operation controller that issues a stop command for stopping the second car at a destination floor specified by the first call and instructs the display to display the destination floor of the second car after a reassignment is performed by the reassigning unit.

According to another aspect of the present invention, there is provided an elevator system in which a plurality of shafts are provided and a plurality of cars are provided at top and bottom in each shaft, comprising: a call registerer for entering a hall call; a tentative assignment finalizing unit for deciding on a shaft to be assigned in response to a first call entered by the call registerer and for tentatively assigning a first car in the shaft; and a reassigning unit for changing an assignment for the first call to a second car in the shaft decided on by the tentative assigning unit after tentatively assigning the first car, depending upon a traffic situation of the elevator system.

According to yet another aspect of the present invention, there is provided a car assignment control method for an elevator system having a plurality of cars provided at top and bottom in the same shaft, comprising the steps of: entering a first call; a tentatively assigning a first car to the first call; and changing the assignment for the first call to a second car that is different from the first car, depending on a traffic situation of the elevator system.

DESCRIPTION OF THE PREFERRED EMBODIMENTS

First Embodiment

Figure 1:
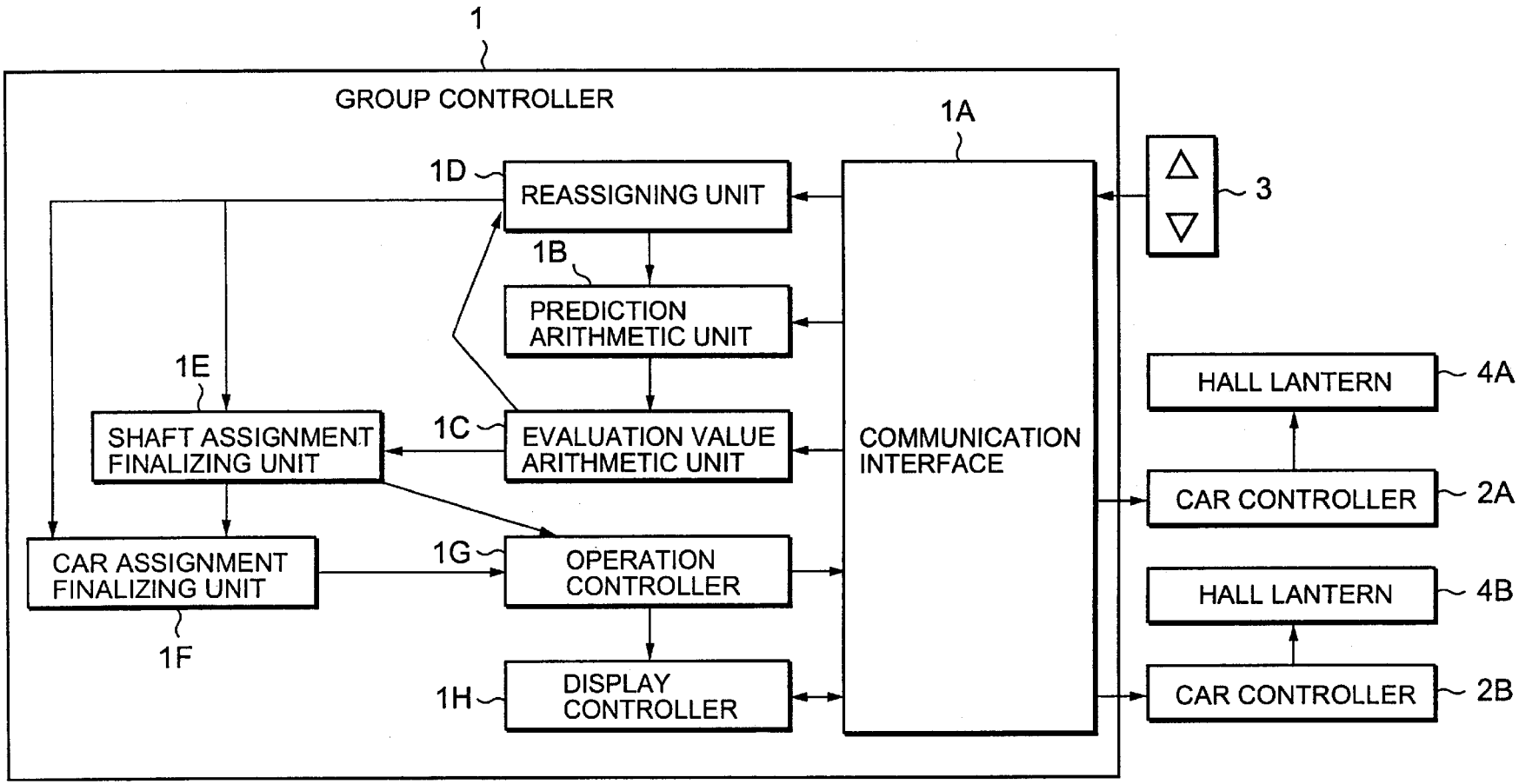
FIG. 1 is a block diagram of a first embodiment in accordance with the present invention.

The following will describe a first embodiment in accordance with the present invention in conjunction with the accompanying drawings. FIG. 1 is a diagram showing a construction of an elevator system according to the first embodiment. An explanation given with reference to FIG. 1 will be focused primarily on a control section of the elevator system.

Referring to FIG. 1, a group controller 1 efficiently controls a plurality of cars, and car controllers 2A and 2B control a plurality of cars in each shaft. In the first embodiment, it is assumed that DD elevators are in service in each shaft.

Reference numeral 3 denotes a well-known call registerer disposed at a hall of each floor. In the first embodiment, an example will be described wherein UP and DOWN buttons are installed at a hall of each floor. The call registerer 3 is disposed at a hall of each floor. In the drawing, however, only one call registerer is shown for simplicity.

When a passenger presses the UP or DOWN button of the call registerer 3, the hall call is registered. This registration actuates the group controller 1 to assign an upper or lower car of one of the shafts to respond to the call.

Reference numerals 4A and 4B denote hall lanterns installed at a hall of each floor. The hall lanterns 4A and 4B enable passengers waiting on each floor to know which car of which shaft is assigned or a car is arriving.

The group controller 1 of FIG. 1 includes elements 1A through 1H described below.

A communication interface 1A performs communication with and data transmission to and from the call registerer 3 and the car controllers 2A and 2B. A prediction arithmetic unit 1B predicts an arriving time and an in-car load when a car is assigned in response to a hall call that occurs. The arriving time means time required for the car to arrive when the car is to stop at the floor where the hall call was generated. The prediction arithmetic unit 1B calculates the arriving time and the in-car load for each car.

An evaluation value arithmetic unit 1C calculates a waiting time and evaluation indexes, such as a prediction error and being full, for each car based on an arithmetic result supplied by the prediction arithmetic unit 1B. A reassigning unit 1D reassigns an upper or lower car as necessary. A reassigning procedure will be described hereinafter.

A shaft assignment finalizing unit 1E comprehensively evaluates the indexes calculated by the evaluation value arithmetic unit 1C to select a car and a shaft to be assigned in response to a hall call. The shaft assignment finalizing unit 1E selects a car having a highest overall evaluation result and a shaft in which the car is in service.

A car assignment finalizing unit 1F makes a final decision on a call assignment of an upper or lower car of each shaft based on a reassignment result supplied by the reassigning unit 1D and an assignment result supplied by the shaft assignment finalizing unit 1E.

An operation controller 1G issues an operation command to a car based on a selection made by the shaft assignment finalizing unit 1E and an assignment command issued by the car assignment finalizing unit 1F. To be more specific, the operation command is sent to the car controllers 2A and 2B via the communication interface 1A, and the plural cars of the individual shafts are controlled by the car controllers 2A and 2B.

A display controller 1H receives signals from the operation controller 1G, and informs a passenger waiting at a hall of a floor which shaft is responding. To be more specific, a display signal from the display controller 1H is sent to the hall lantern 4A or 4B via the communication interface 1A, and the hall lantern 4A or 4B turns ON.

An operation of the first embodiment will now be described in conjunction with the accompanying drawings.

Figures 2A, 2B, 2C:
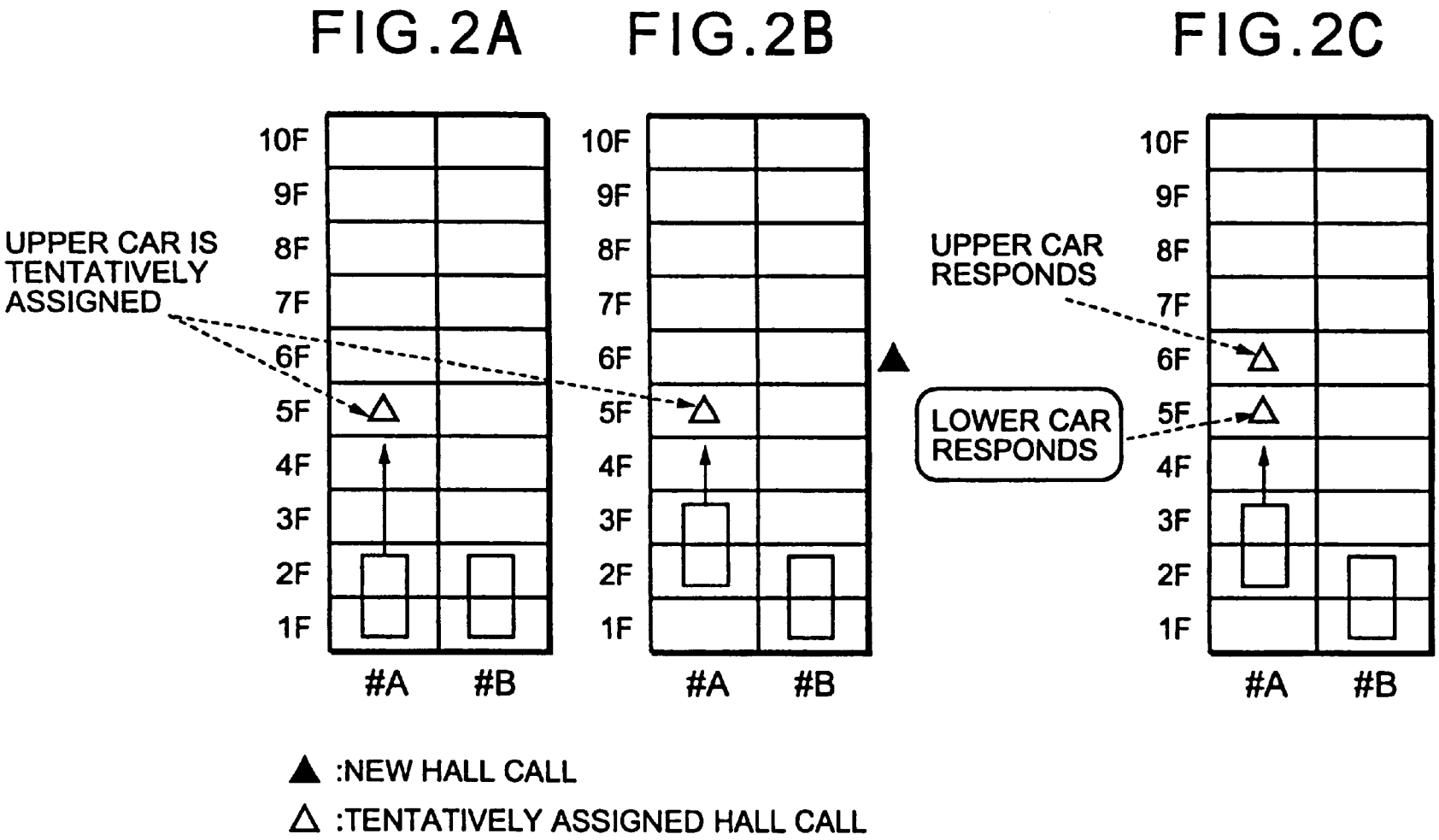
FIGS. 2A, 2B, and 2C are schematic representations for describing an operation of the first embodiment.
Figure 3:
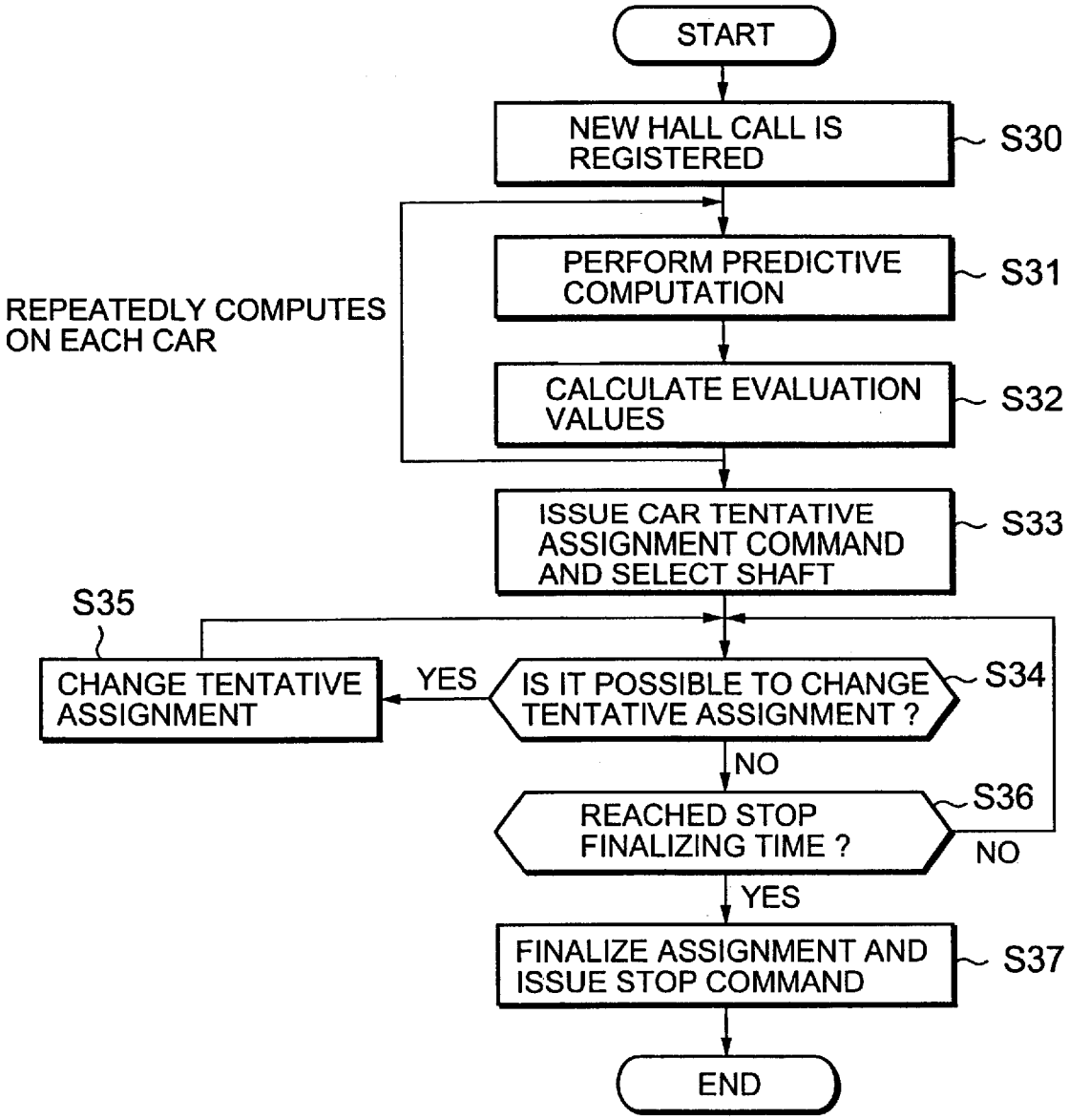
FIG. 3 is a flowchart showing an outline of an operation procedure in the first embodiment.
Figure 4:
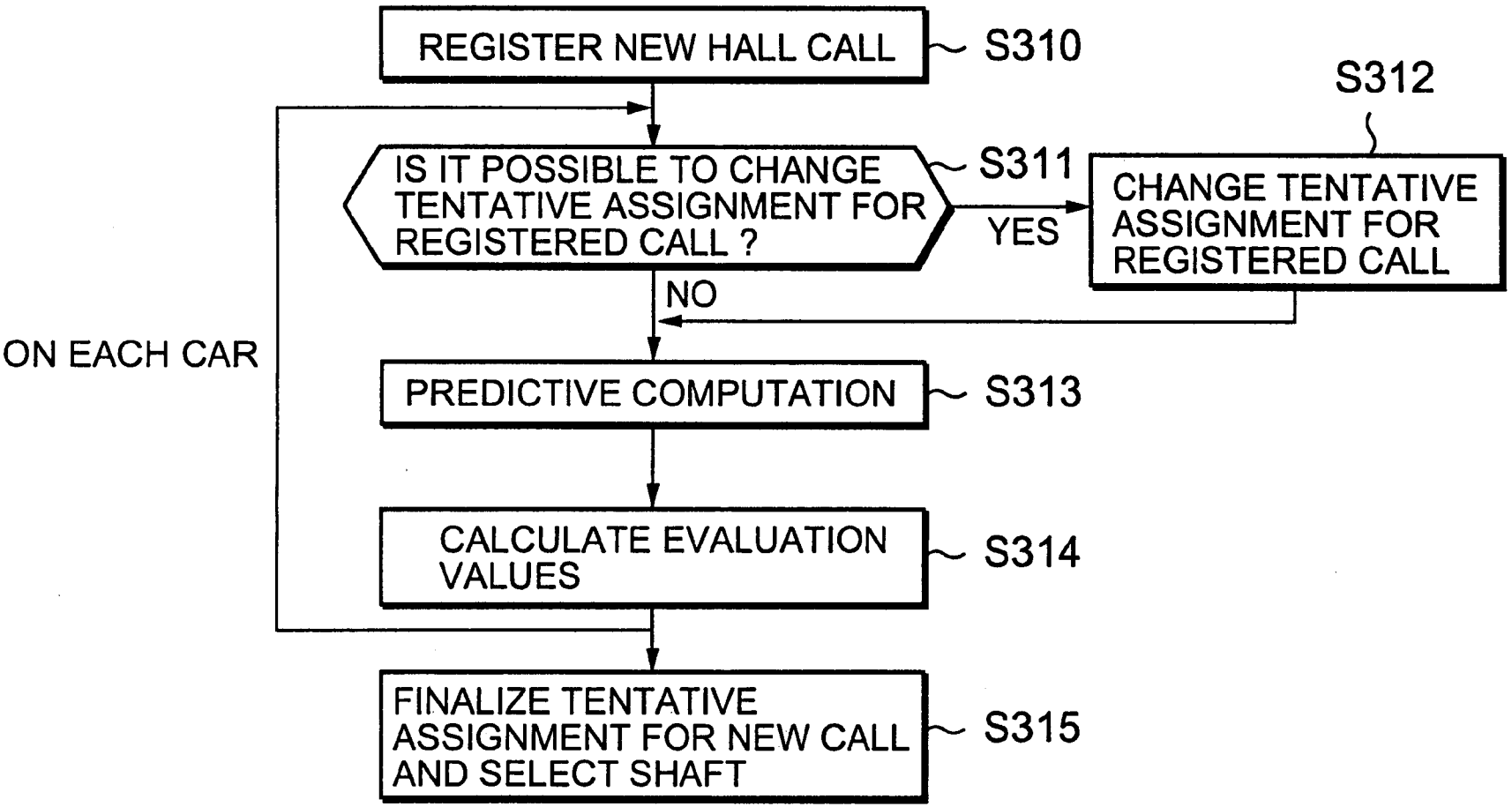
FIG. 4 is another flowchart showing the outline of the operation procedure in the first embodiment.

FIGS. 2A, 2B, and 2C are schematic representations for describing an operation of the first embodiment, and FIG. 3 and FIG. 4 are flowcharts outlining the operation.

First, a button of the call registerer 3 is pressed, and this new call is input through the communication interface 1A (a step S30). Then, a procedure of steps S31 and S32 is implemented for each car of each shaft.

In the step S31, a predicted time of arrival at a floor and a predicted in-car load at the floor are computed, assuming that a car has been assigned to the new call. In the step S32, various evaluation values, such as a waiting time, are computed based on the prediction arithmetic results mentioned above. The procedure in the steps S31 and S32 is carried out by the prediction arithmetic unit 1B and the evaluation value arithmetic unit 1E.

Subsequently, in a step S33, the shaft assignment finalizing unit 1E selects a car having the best overall evaluation result and a shaft in which the car is in service, based on the evaluation values obtained in the step S32. A signal indicating the selection result is transferred from the shaft assignment finalizing unit 1E to the operation controller 1G. Upon receipt of the signal, the operation controller 1G instructs the car controllers 2A and 2B to issue a tentative assignment command to the selected car and also informs the display controller 1H of the selected car and shaft. The display controller 1H turns ON the hall lantern 4A or 4B, which corresponds to the selected shaft, at a floor where the call has been registered.

After the shaft and the car have been tentatively assigned according to the above procedure, a procedure of steps S34 and S35 is implemented at regular intervals until it is determined in a step S36 that a stop finalizing time has reached. The stop finalizing time refers to a time at which a decision is made to stop the tentatively assigned car at the floor where the call has been registered. The time is decided by taking into account the floor where the call has been registered, position of the car, time required for the car to stop, etc. More specifically, a time at which the car starts an arriving operation or a time advanced from the time at which the car starts the arriving operation, by the time required for arithmetic processing.

In a step S34, it is determined whether it would be more advantageous if another car in the shaft selected in the step S33 would respond, and if a result of the determination is affirmative, then reassignment is 25 performed in a step S35. A procedure of the step S34 can be accomplished by recalculating the evaluation values as in the steps S31 and S32.

The determination of the step S34 and the reassignment in the step S35 are performed by the reassigning unit 1D.

If it is determined in a step S36 that the stop finalizing time has reached, then the car assignment finalizing unit 1F decides to finalize the tentative assignment of the car, and transmits a decision command to the operation controller 1G. The operation controller 1G issues a stop command to the car on which the assignment has been finalized.

This completes the outline of the operation. In this embodiment, from the moment tentative assignment is finalized to the moment the stop finalizing time of the tentatively assigned car is reached, the result of the tentative assignment is reviewed at regular intervals so as to carry out reassignment as necessary.

In the description given above in conjunction with the flowchart, a result of tentative assignment is reviewed at regular intervals from the moment tentative assignment is implemented to the moment the stop finalizing time of the car tentatively assigned is reached. Depending on a traffic situation, however, a result of tentative assignment may be changed if a new call occurs thereafter. This will be explained with reference to FIG. 2 and FIG. 4. Processing illustrated in FIG. 4 is implemented after completion of the processing of steps S30 through S33 of FIG. 3.

First, if a separate new call is generated after tentative assignment, if step S310 of FIG. 4 is performed, then it is determined in a step S311 whether the tentative assignment for a registered call (a call registered before the new call is generated) should be changed. This will be explained in conjunction with FIGS. 2A, 2B, and 2C. An elevator system shown in FIGS. 2A, 2B, and 2C is a DD elevator having an upper car and a lower car, and the upper car and the lower car stop at upper and lower floors, respectively.

FIG. 2A shows a case where a call generated at a fifth floor requesting transport to an upper floor has been registered, and an upper car of a shaft #A has been tentatively assigned for the call. The call occurred at the fifth floor requesting for the upward transport is a call that has already registered. This illustrates a state wherein the step S33 of FIG. 3 has been completed.

FIG. 2B illustrates a case wherein a new call for going up is generated at a hall of a sixth floor after a call shown in FIG. 2A is generated. The call generated on the sixth floor is the new call. This situation corresponds to the step S310.

In this case, if an upper car of a shaft #A is tentatively assigned to the new call generated on the sixth floor, then the upper car of the shaft #A has to stop twice, namely, at a fifth floor and the sixth floor.

However, as illustrated in FIG. 2C, if reassignment is made so that the call generated at the fifth floor is assigned to a lower car, then the shaft #A will be able to respond to both calls at the fifth and sixth floors by stopping only once. This is obviously advantageous from a viewpoint of transporting efficiency. The aforesaid reassignment, however, cannot be accomplished after the cars begin their arriving operations. For this reason, reassignment is possible up to a predetermined time (the stop finalizing time) prior to arrival, considering an allowance for a computing time.

The determination regarding whether the tentative assignment of the registered call can be changed or not corresponds to the step S311.

In other words, if a new call is generated at the sixth floor before the upper car of the shaft #A, which has been tentatively assigned to the registered call at the fifth floor, starts its operation for stopping at the fifth floor, then reassignment is performed as shown in FIG. 2C. This processing corresponds to the step S312.

The reassignment described above can be implemented by, for example, applying the following rule:

IF: a call assigned to a certain upper (lower) car is reassigned to a lower (upper) car, the number of stops can be reduced.

THEN: the call assigned to the upper (lower) car should be reassigned.

The steps S311 through S312 are implemented by the reassigning unit 1D.

After the tentative assignment to a registered call is changed as necessary in the steps S311 and S312, the prediction computation and the evaluation value calculation of steps S313 and S314 are performed, and tentative assignment and shaft selection for a new call are carried out in a step S315. Furthermore, the display controller 1H is informed of the tentatively assigned car and the selected shaft then a hall lantern associated with the shaft is turned ON. The procedure is identical to that of the step S31 and after in FIG. 3; hence, the description thereof will not be repeated. In the situation illustrated in FIG. 2, the change has been made to reassign the call at the fifth floor to the lower car in the step S312. Therefore, based on a result of the change, the selection of a shaft and tentative assignment of a car are carried out for the new call.

In the elevator system in accordance with this embodiment, tentative assignment is performed when a call is registered, and from the moment tentative assignment is finalized to the moment the stop finalizing time of the tentatively assigned car is reached, a result of the tentative assignment is reviewed at regular intervals so as to carry out reassignment as necessary. This arrangement permits flexible assignment to successfully cope with situation changes of the elevator, such as occurrence of a newly registered call, thus leading to higher transporting efficiency.

Especially when a newly registered call occurs after tentative assignment has been performed, the result of the tentative assignment is reviewed, taking the assignment for the new call into account. Hence, efficient operational control of cars can be achieved.

In this embodiment, the car assignment change has been made so that another car in a shaft determined by the shaft assigning unit 1E is assigned. Therefore, at a point when the shaft has been selected by the shaft assigning unit 1E (the car has been tentatively assigned), a passenger can be informed of the shaft, which has been assigned, by means of a hall lantern. Even when reassignment of a car happens, the passengers will still wait in front of the same shaft. This helps prevent confusion of the passengers.

In the present embodiment, the descriptions have been given for a DD elevator; however, the present invention can be also applied to an MC elevator wherein a plurality of cars that are independently drive-controlled, are disposed in the same shaft.

Second Embodiment

Figure 5:
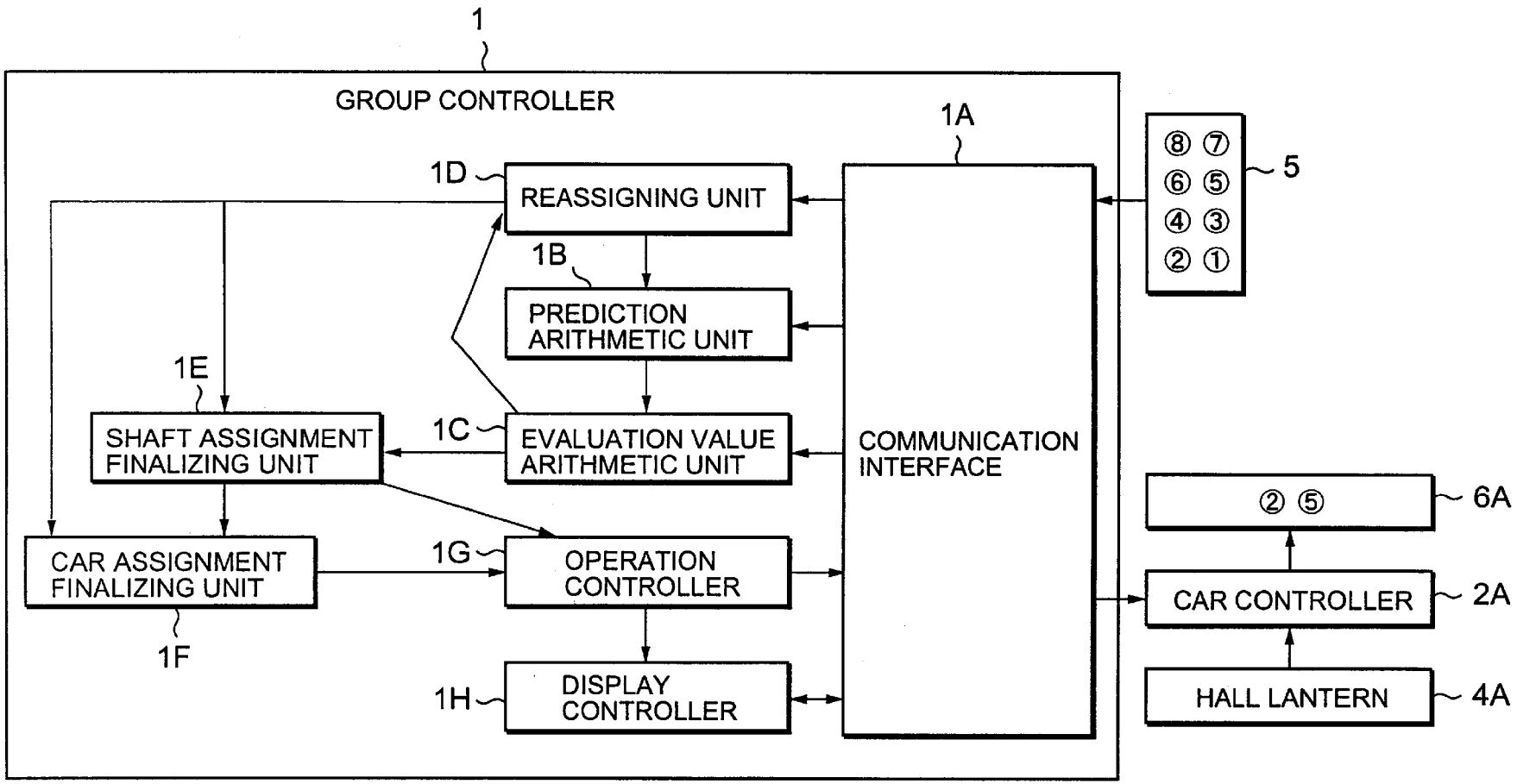
FIG. 5 is a general block diagram of a second embodiment in accordance with the present invention.

FIG. 5 is a diagram showing a construction of an elevator system according to a second embodiment of the present invention. An explanation given with reference to FIG. 5 will be focused primarily on a control section of the elevator system. As in the case of the first embodiment, the elevator is a DD elevator.

The construction shown in FIG. 5 is substantially identical to that of FIG. 1 in the first embodiment, so that only different aspects will be discussed.

Reference numeral 5 denotes a destination registerer (shown in the form of destination buttons in the drawing) installed at a hall. The destination registerer 5 is installed at a hall of each floor. Each destination registerer 5 is provided with destination buttons, and a passenger presses a destination button to register a destination floor. Since the destination registerer registers a call when a destination button is pressed, it may be considered as a type of a call registerer.

Furthermore, a hall lantern 4A and a destination display unit 6A for displaying a destination floor of an arriving car are connected to each car controller 2A. The destination display unit 6A is also installed at a hall of each floor. This arrangement enables a passenger at a floor to know which floor a car that has arrived is heading for a next stop by checking a display on the destination display unit 6A.

Reference numeral 1 denotes a group controller for efficiently controlling a plurality of cars. Functions of 1A through 1H making up the group controller 1 are virtually the same as those shown in FIG. 1; therefore, the same reference numerals as those shown in FIG. 1 are assigned.

When a destination floor is registered through the destination registerer 5 at a hall, the group controller 1 recognizes the occurrence of a destination call, and assigns an upper or lower car of a shaft to the destination call to respond to the destination call. At least when the car arrives, the destination of the car will be displayed on the destination display unit 6A.

An operation of the second embodiment will now be described in conjunction with FIG. 6 and FIG. 7.

Figure 6A:
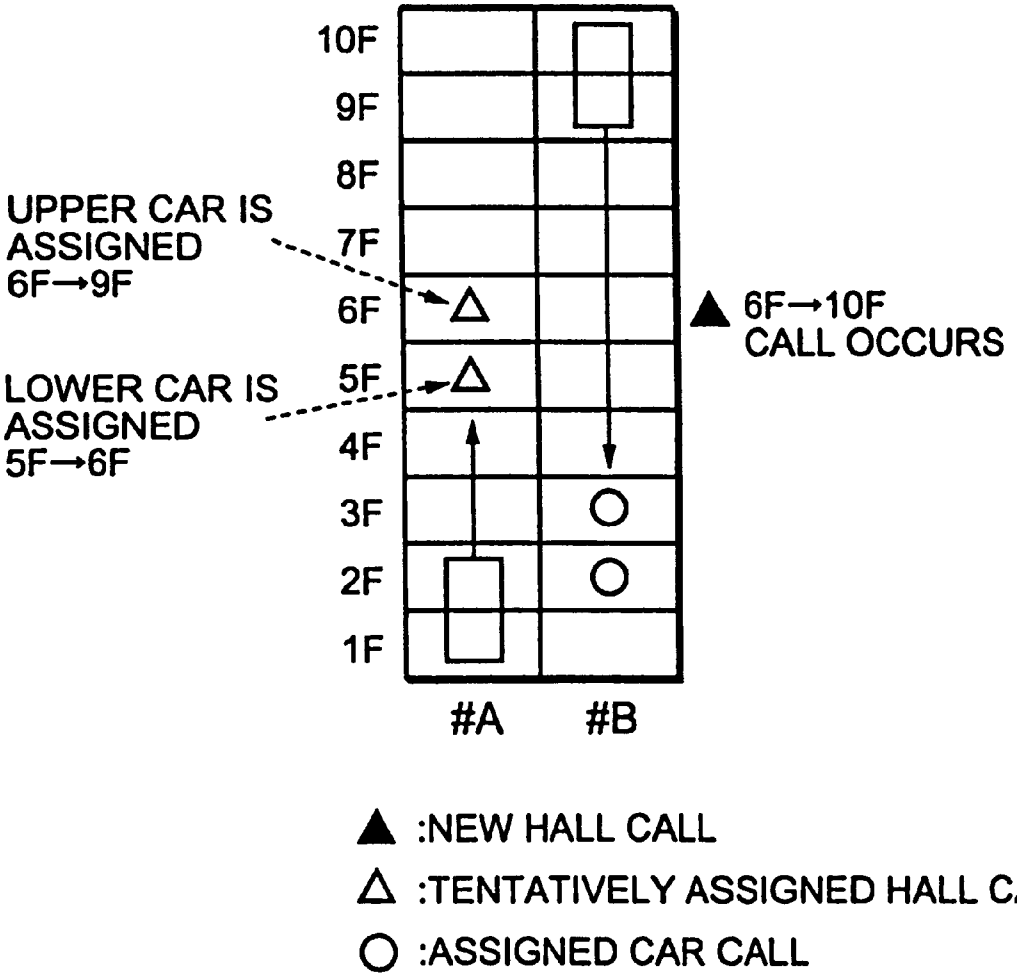
FIGS. 6A and 6B are schematic representations for describing an operation of the first embodiment.
Figure 6B:
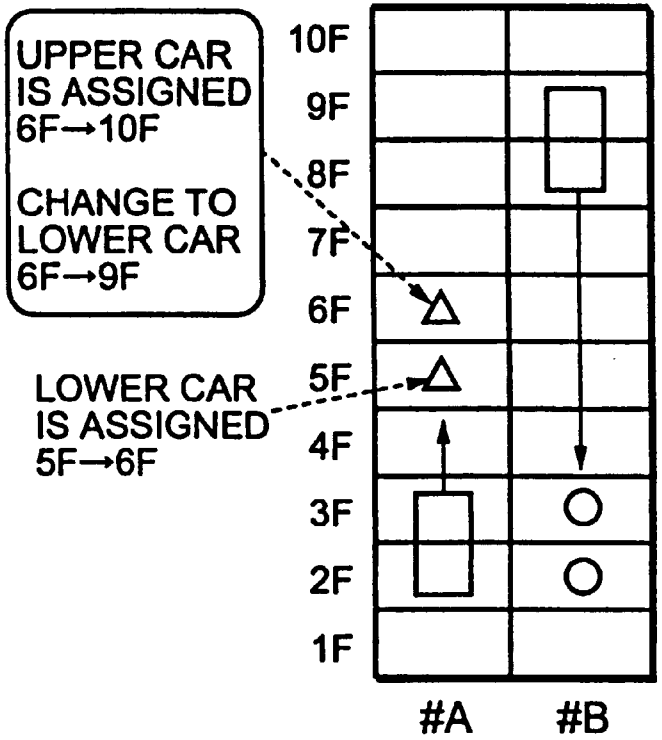

FIGS. 6A and 6B are schematic representations for describing an operation of the second embodiment, and FIG. 3 is a flowcharts outlining the operation. The flowchart illustrates an operation of a case wherein a new destination call occurs after tentative assignment to a registered destination call has been performed by the steps S30 through S33 shown in FIG. 3 of the first embodiment.

Figure 7:
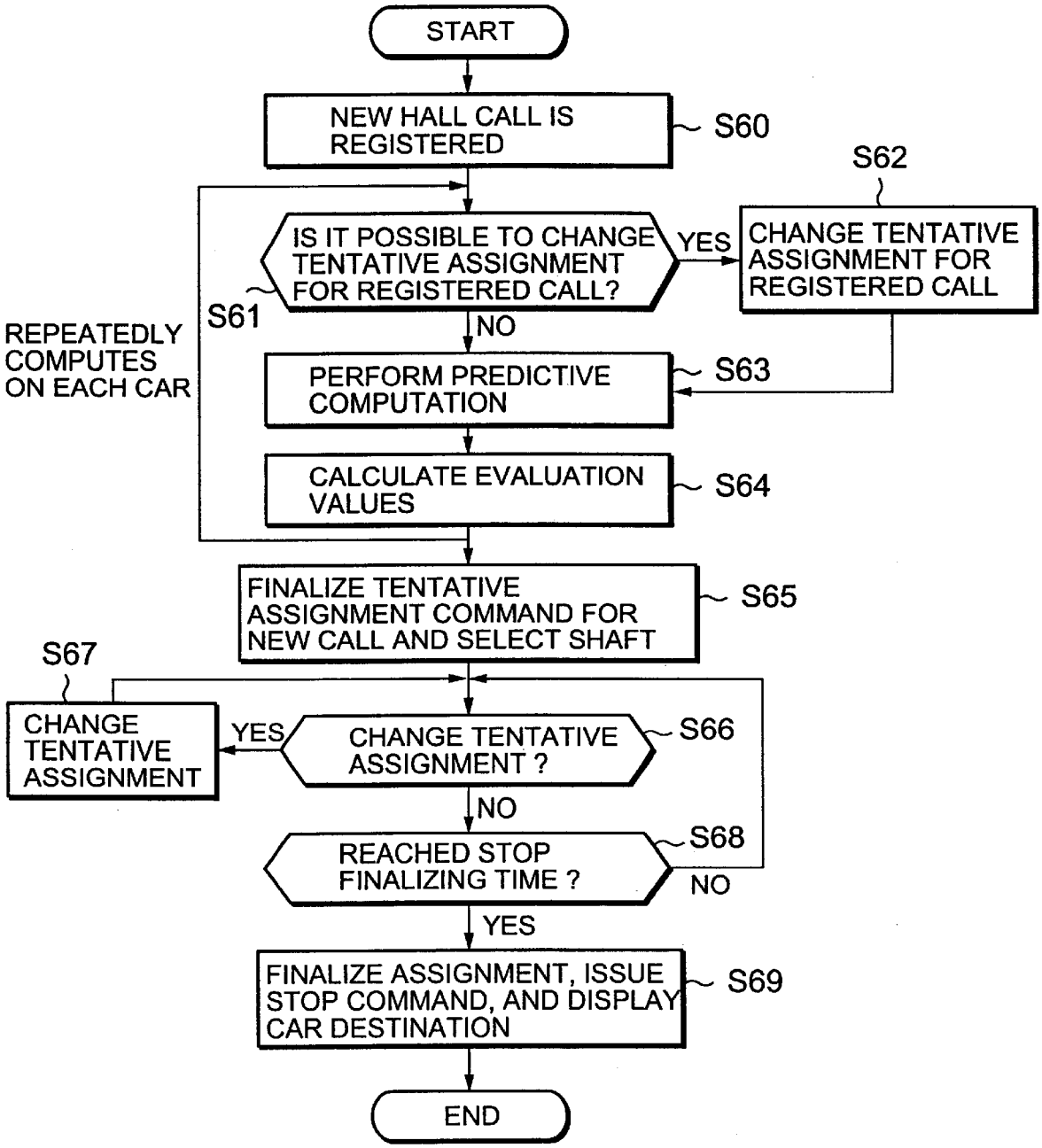
FIG. 7 is a flowchart showing an outline of an operation procedure in the second embodiment.

First, in a step S60 of FIG. 7, when the occurrence of a destination call is recognized through a communication interface 1A, it is determined in a step S61 whether it is possible to change the tentative assignment to the already registered destination call. If the change is possible, then the tentative assignment is changed in a step S62. This will be explained with reference to FIGS. 6A and 6B.

In a case shown in FIG. 6A, a lower car of a shaft #A has been tentatively assigned to a destination call requesting for the transport from a fifth floor to a sixth floor (5th floor→6th floor), and an upper car of the shaft #A has been tentatively assigned to a destination call requesting for the transport from the sixth floor to a ninth floor (6th floor→9th floor), while a new destination call requesting for transport from the sixth floor to a tenth floor (6th floor→10th floor) has occurred. The destination call requesting for the transport from the fifth floor to the sixth floor and the destination call requesting the transport from the sixth floor to the ninth floor are registered destination calls. The newly generated destination call requesting the transport from the sixth floor to the tenth floor is the new destination call. This shows a state wherein the step S60 of FIG. 7 has been completed.

In this case, if the tentative assignment to the lower car and the upper car of the shaft #A are left unchanged, and the new destination call (6th floor→10th floor) is tentatively assigned to an upper car having a call from the same sixth floor, then the lower car and the upper car of the shaft #A will stop according to the following orders:

Lower car: 5th floor→6th floor→8th floor→9th floor
Upper car: 6th floor 7th floor→9th floor→10th floor The lower car stops at the eighth floor and the ninth floor because the upper car stops at the ninth floor and the tenth floor. The upper car stops at the seventh floor because the lower car stops at the sixth floor.

As shown in FIG. 6B, however, if the tentative assignment for the registered destination call requesting for the transport from the sixth floor to the ninth floor (6th floor→9th floor) is changed to the upper car, then the upper car of the shaft #A will stop according to the following order:

Lower car: 5th floor→6th floor→9th floor
Upper car: 6th floor→7th floor→10th floor The upper car stops at the seventh floor because the lower car stops at the sixth floor.

Accordingly, the number of stops can be reduced by changing the tentative assignment as shown in FIG. 6B, providing an obvious advantage from the viewpoint of the transporting efficiency of the DD elevator. However, the tentative assignment cannot be changed after the car begins its operation for arriving at a floor where the call has taken place; therefore, the change is possible up to a predetermined time (the stop finalizing time) prior to arrival, considering an allowance of a computing time. The determination corresponds to the step S61 of FIG. 7.

In other words, if a new destination call requesting for the transport from the sixth floor to the tenth floor is generated before the upper car, which has been tentatively assigned to the registered call requesting for the transport from the sixth floor to the ninth floor, starts its operation for stopping at the sixth floor, then the tentative assignment is changed as shown in FIG. 6B. This processing corresponds to the step S62.

The processing of the steps S61 and S62 is implemented by the reassigning unit 1D.

After the tentative assignment to a registered destination call is changed as necessary as described above, the prediction computation and the evaluation value calculation are performed in steps S63 and S64. Based on the results, a shaft is selected and a car to be tentatively assigned is decided for the new call in a step S65. Processing of the step S63 is carried out by a prediction arithmetic unit 1B, processing of the step S64 is carried out by an evaluation value arithmetic unit 1C, and processing of the step S65 is carried out by a shaft 1assigning unit 1E.

A procedure from steps S65 through S68 are virtually the same as that from the steps S33 through S36 in the first embodiment; hence, the description thereof will not be repeated. The units for implementing the steps are also the same as those of the first embodiment.

When the time for the car to stop at the assigned floor is reached (YES in the step S68) after the tentative assignment is performed and an operation command is issued for the new destination call, the assignment is finalized and a stop command is issued in a step S69, and the destination of the arriving car is displayed on a destination display unit 6 so as to inform a passenger of the destination of the car.

Figure 8A:
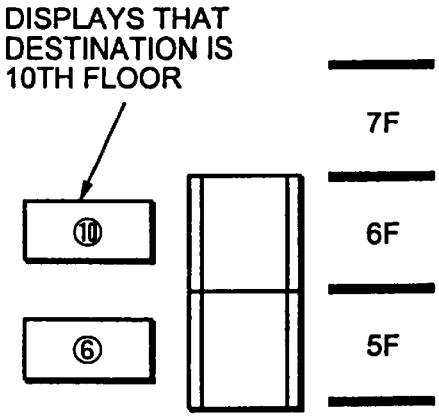
FIGS. 8A and 8B are schematic representations for describing an operation of the first embodiment.

The display provided by the destination display unit 6 will be described, taking a case of FIG. 6B as an example. In this case, when the lower car of the shaft #A arrives at the fifth floor and the upper car arrives at the sixth floor, the destination display unit 6 displays that the lower car is at the fifth floor and will go only to the sixth floor, while the upper car is at the sixth floor and will go only to the tenth floor as shown in FIG. 8A. The display indicating that the upper car will go only to the tenth floor makes it possible to prevent a passenger waiting at the sixth floor and wishing to go to the ninth floor from getting in the upper car.

Figure 8B:
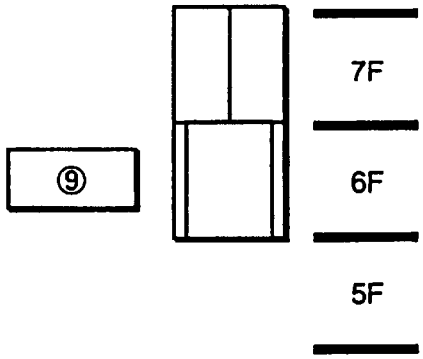

Then, when the lower car stops at the sixth floor, the destination display unit 6 displays that the lower car will go to the ninth floor, prompting passengers going to the ninth floor to get in the lower car as shown in FIG. 8B.

In the elevator system according to the second embodiment, tentative assignment is performed when a destination call is registered, and from the moment tentative assignment is finalized to the moment the stop finalizing time of the tentatively assigned car is reached, a result of the tentative assignment is reviewed at regular intervals so as to change the tentative assignment as necessary. Especially when a new destination call occurs after tentative assignment has been finalized, a result of the tentative assignment is reviewed, taking assignment for the new destination call into account. Hence, efficient operation control of cars can be achieved.

Moreover, the destination display unit 6 displays the information after a stop command has been issued and an assignment has been finalized, making it possible to prevent passengers at each floor from taking wrong cars. The processing from the steps S61 through S65 is carried out for all cars of all shafts.

In the specific example of FIGS. 6A and 6B, the descriptions have been given only of the assignment to the upper car and the lower car of the shaft #A for the purpose of simplicity. It is alternatively possible to review for changing assignment, taking into account assignment situations of an upper car and a lower car other than the shaft #A.

Third Embodiment

In a third embodiment according to the present invention, descriptions will be given of a case wherein the group controller discussed in the second embodiment is applied to an MC elevator.

In this case, a general construction and an operation procedure outline are virtually the same as those of the second embodiment. To be more specific, FIG. 5 and FIG. 7 can be applied as they are to this embodiment.

Figure 9A:
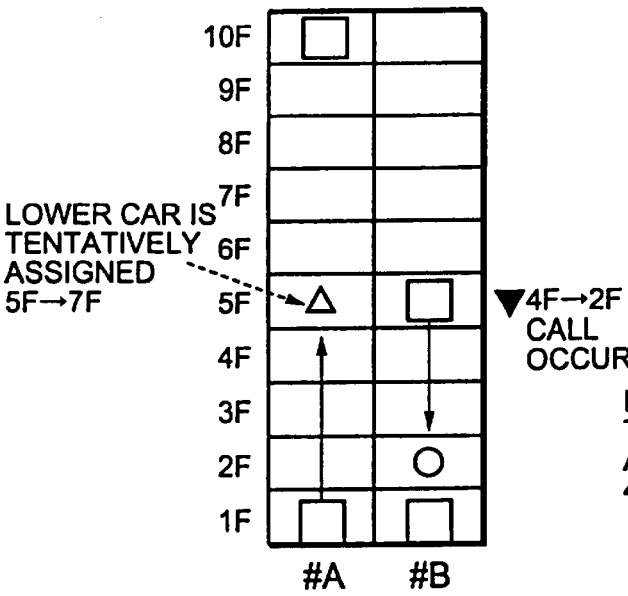
FIGS. 9A and 9B are schematic representations for describing an operation of the first embodiment.
Figure 9B:
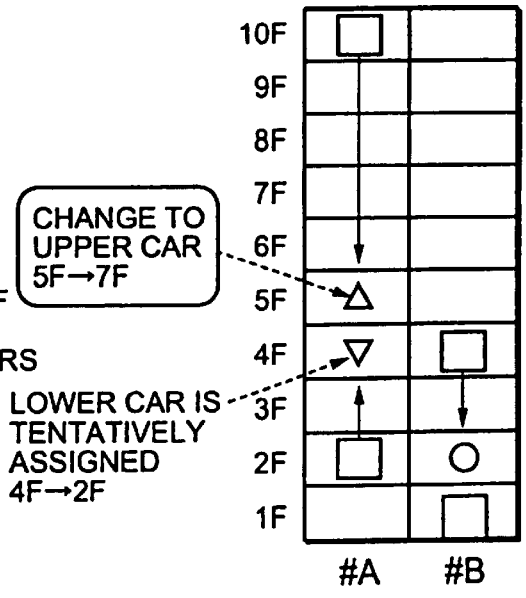

Accordingly, a general block diagram and a flow chart of the operation will be omitted. Referring to FIGS. 9A and 9B, an example of reassignment will be described.

FIG. 9A illustrates a situation wherein a lower car of a shaft #A has been tentatively assigned to a destination call requesting for transport from a fifth floor to a seventh floor (5th floor→7th floor), and a new destination call requesting for transport from a fourth floor to a second floor (4th floor→2nd floor) has occurred. It will be described whether a tentative assignment to a registered call can be changed or not before tentatively assigning the new call (4th floor→2nd floor) to an upper/lower car of the shaft #A or #B.

If the new call requesting for the transport from the fourth floor to the second floor (4th floor→2nd floor) is tentatively assigned to the upper car of the shaft #A, then the registered call (5th floor→7th floor) must be reassigned to the upper car. This is because, if no such reassignment is performed, then the upper car will not be able to respond to the new call (4th floor→2nd floor) until the lower car responds to the registered call (5th floor→7th floor), then stands by at a first floor, resulting in a great time loss for the lower car standing by.

If the registered call (5th floor→7th floor) is reassigned to the upper car, then the lower car will stop at a nearest floor without responding to the call. The upper car will stop in an order of the 4th floor→the 2nd floor→the 5th floor→the 7th floor.

If the new call (4th floor→2nd floor) is tentatively assigned to the lower car of the shaft #A, then reassigning the registered call (5th floor→7th floor) to the upper car will be obviously more advantageous in terms of waiting time. If the reassignment is performed, then the lower car will stop in the following order, namely, 4th floor→the 2nd floor, while the upper car will stop in the following order, namely, the 5th floor→the 7th floor as shown in FIG. 8B.

If the new call (4th floor→2nd floor) is assigned to a car of the shaft #B, then it is obviously unnecessary to reassign the registered call (5th floor→7th floor) of the shaft #A.

The aforesaid reassigning procedure can be implemented according to the following rule:

IF: a call for a certain upper (lower) car is reassigned to a lower (upper) car, (retreating loss time is reduced) or (waiting time greatly reduces), THEN: reassign the call for the upper (lower) car to the lower (upper) car.

According to the procedure and the rule described above, whether changing tentative assignment is possible or not is determined in a step S61 of FIG. 7. In this case also, it is impossible to change the tentative assignment after a tentatively assigned car begins its operation for an arrival. Hence, the change is possible up to a predetermined time prior to the arrival (a stop finalizing time), considering an allowance for a time required for computation.

Thereafter, if it is determined that the tentative assignment can be changed, then the tentative assignment is changed in a step S62. The processing in the step S61 and the step S62 are carried out by a reassigning unit 1D.

Subsequently, prediction computation and the evaluation value calculation of steps S63 and S64 are performed, and a car providing the best result as a whole is selected to be assigned. Tentative assignment for the new call is finalized in a step S65. Operations after a step S66 are identical to those of the second embodiment. The units for performing the operations are also the same.

In the elevator system according to the third embodiment, tentative assignment is performed when a destination call is registered, and from the moment tentative assignment is finalized to the moment the stop finalizing time of the tentatively assigned car is reached, a result of the tentative assignment is reviewed at regular intervals so as to change the tentative assignment as necessary. Especially when a new destination call occurs after tentative assignment has been finalized, a result of the tentative assignment is reviewed, taking assignment for the new destination call into account. Hence, efficient operation control of cars can be achieved.

Moreover, a destination display unit 6 displays the information after a stop command has been issued and an assignment has been finalized, making it possible to prevent passengers at each floor from taking wrong cars.

In the elevator systems described above, the descriptions have been given of only the cases where two cars, upper and lower cars, are provided in a single shaft. The present invention, however, can be also applied to an elevator system having three or more cars provided in a single shaft.

The shaft assignment finalizing unit 1E in the above embodiments functions to select a shaft and also serves as a tentative assignment finalizing unit for tentatively assigning a car. The destination floor registerer 5 in the second embodiment registers a call when a destination button is pressed, and is an example of a call registerer.

Thus, the elevator system in accordance with the present invention in which a plurality of cars are provided at top and bottom in the same shaft, comprises: a call registerer for entering a hall call; a tentative assignment finalizing unit for tentatively assigning a first car in response to a first call entered by the call registerer; and a reassigning unit for changing an assignment for the first call to a second car that is different from the first car after tentatively assigning the first car, depending upon a traffic situation of the elevator system. With this arrangement, flexible assignment based on a change in a traffic situation of the elevator system can be achieved.

The reassigning unit changes the assignment for the first call if a second call that is different from the first call occurs after the first car has been tentatively assigned. With this arrangement, transporting efficiency can be improved in handling a new call.

The reassigning unit determines whether a predetermined time before the first car arrives at a floor where the first call occurred has been reached or not, and if the predetermined time has not been reached, then the assignment for the first call is changed. This arrangement makes it possible to prevent the assignment from being changed after the car starts a stopping operation.

The reassigning unit changes the assignment in response to the first call to the second car in the shaft wherein the first car is in service. With this arrangement, display of a shaft to a passenger at a hall can be performed at an early stage.

The call registerer registers a call by entering a destination floor, and the reassigning unit changes an assignment performed in response to the first call according to a destination floor entered at the first call and a destination floor entered at the second call. This arrangement permits further efficient operation control based on a destination floor.

The call registerer registers a call by entering a destination floor, a display for displaying a destination floor of the second car according to a result of reassignment performed by the reassigning unit. This arrangement makes it possible to prevent a passenger from taking a wrong car.

The elevator system further comprises an operation controller that issues a stop command for stopping the second car at a destination floor specified by the first call and instructs the display to display the destination floor of the second car after a reassignment is performed by the reassigning unit. Hence, the displaying means displays only information after a change has been made, preventing confusion of passengers.

The elevator system in which a plurality of shafts are provided and a plurality of cars are provided at top and bottom in each shaft, comprising: a call registerer for entering a hall call; a tentative assigning unit for deciding on a shaft to be assigned in response to a first call entered by the call registerer and for tentatively assigning a first car in the shaft; and a reassigning unit for changing an assignment for the first call to a second car in the shaft decided on by the tentative assigning unit after tentatively assigning to the first car, depending upon a traffic situation of the elevator system. With this arrangement, flexible assignment for successfully coping with a change in a traffic situation of the elevator system can be achieved without annoying passengers when a car is reassigned.

The car assignment control method for an elevator system having a plurality of cars provided at top and bottom in the same shaft, comprising the steps of: entering a first call; a tentatively assigning a first car to the first call; and changing the assignment for the first call to a second car that is different from the first car after tentatively assigning to the first car, depending on a traffic situation of the elevator system. This permits flexible assignment according to a change in a traffic situation of the elevator system.

What is claimed is:

1. An elevator system in which a plurality of cars are provided in the same shaft, the system comprising:

a call registerer for registering a hall call;

a tentative assignment finalizing unit for tentatively assigning a first car in response to a first hall call registered through the call registerer; and a reassigning unit for determining whether a time period before the first car arrives at the floor where the first hall call occurred has been reached, and, if the time period has not been reached, changing the car assigned for responding to the first hall call.

2. An elevator system in which a plurality of cars are provided in the same shaft, the system comprising:

a call registerer for registering a hall call by entering a destination floor a tentative assignment finalizing unit for tentatively assigning a first car in response to a first hall call entered through the call registerer; and a reassigning unit for changing a car assignment for responding to the first hall call if a second hall call, different from the first hall call, occurs after the first car has been tentatively assigned, according to a destination floor entered at the first hall call and a destination floor entered at the second hall call.

3. An elevator system in which a plurality of cars are provided in the same shaft, the system comprising:

a call registerer for registering a hall call by entering a destination floor;

a tentative assignment finalizing unit for tentatively assigning a first car in response to a first hall call registered by the call registerer; and a reassigning unit for changing a car assignment of the first car for responding to the first hall call to a second car, different from the first car, after tentatively assigning the first car, depending upon traffic of the elevator system, wherein the call registerer includes displaying means for displaying a destination floor of the second car, according to a car reassignment performed by the reassigning unit.

4. The elevator system according to claim 3, further comprising an operation controller that issues a stop command for stopping the second car at a destination floor specified by the first hall call and instructs the displaying means to display the destination floor of the second car after the reassignment by the reassigning unit.

5. An elevator system in which a plurality of cars are provided in the same shaft, the system comprising:

a call registerer for registering a hall call;

a tentative assignment finalizing unit for deciding on a shaft to be assigned in response to a first hall call registered by the call registerer and for tentatively assigning a first car in the shaft assigned to respond to the first hall call; and a reassigning unit for changing a car assignment for responding to the first hall call to a second car in the shaft assigned to respond by the tentative assignment unit, after tentatively assigning the first car, depending upon traffic of the elevator system.

6. A car assignment control method for an elevator system in which a plurality of cars are provided in the same shaft, the method comprising:

entering a first hall call;

tentatively assigning a first car in response to the first hall call; and changing the car assignment for responding to the first hall call to a second car, different from the first car, after tentatively assigning the first car, depending upon traffic of the elevator system, only if a time period before the first car arrives at the floor where the first hall call occurred has not been reached.

7. An elevator system in which a plurality of cars are provided in the same shaft, the system comprising:

a call registerer for registering a hall call;

a tentative assignment finalizing unit for tentatively assigning a first car in response to a first hall call registered through the call registerer; and a reassigning unit for determining whether a time period before the first car arrives at the floor where the first hall call occurred has been reached, and, if the time period has been reached, preventing changing of the car assigned for responding to the first hall call.

8. The elevator system according to claim 7, wherein the call registerer registers a hall call by entering a destination floor and the reassigning unit changes a car assignment in response to the first hall call according to destination floor entered at the first hall call and the destination floor entered at the second hall call.

9. The elevator system according to claim 7, wherein the call registerer registers a hall call by entering a destination floor and includes displaying means for displaying a destination floor of the second car, according to a car reassignment performed by the reassigning unit.

10. The elevator car system according to claim 9, further comprising an operation controller that issues a stop command for stopping the second car at a destination floor specified by the first hall call and instructs the displaying means to display the destination floor of the second car after the reassignment by the reassigning unit.

* * * * *